US007539321B2

(12) United States Patent
Jang

(10) Patent No.: US 7,539,321 B2
(45) Date of Patent: May 26, 2009

(54) DIGITAL HEARING AID ENHANCING DIRECTIONAL PERFORMANCE

(75) Inventor: Soon-Suck Jang, KwangJu (KR)

(73) Assignee: Algorkorea Co., Ltd., KwangJu (KR)

( * ) Notice: Subject to any disclaimer, the term of this patent is extended or adjusted under 35 U.S.C. 154(b) by 431 days.

(21) Appl. No.: 10/574,304

(22) PCT Filed: Jun. 16, 2005

(86) PCT No.: PCT/KR2005/001846

§ 371 (c)(1),
(2), (4) Date: Apr. 3, 2006

(87) PCT Pub. No.: WO2006/004327

PCT Pub. Date: Jan. 12, 2006

(65) Prior Publication Data

US 2007/0121978 A1 May 31, 2007

(30) Foreign Application Priority Data

Jun. 30, 2004 (KR) ..... 10-2004-0052145

(51) Int. Cl.
*H04R 25/00* (2006.01)

(52) U.S. Cl. ..... 381/328; 381/313

(58) Field of Classification Search ..... 381/23.1, 381/313, 314, 320, 322, 324, 328; 704/271
See application file for complete search history.

(56) References Cited

U.S. PATENT DOCUMENTS

| | | | | |
|---|---|---|---|---|
| 4,449,018 | A | 5/1984 | Stanton | |
| 5,360,388 | A | 11/1994 | Spindel et al. | |
| 5,434,924 | A * | 7/1995 | Jampolsky | 381/320 |
| 2005/0095564 | A1 * | 5/2005 | Stuart et al. | 704/271 |

FOREIGN PATENT DOCUMENTS

| | | |
|---|---|---|
| JP | 5544239 | 3/1980 |
| KR | 10-2000 0064472 | 11/2000 |
| KR | 20 0302614 | 2/2003 |

* cited by examiner

*Primary Examiner*—Brian Ensey
(74) *Attorney, Agent, or Firm*—Ladas & Parry LLP

(57) ABSTRACT

A digital hearing aid enhancing a directional performance for a patient who suffers from sole-ear hearing impairments is provided, in which the digital hearing aid cell inserted into one healthy ear is electrically connected with another digital hearing aid cell called an ear cell including a microphone worn in the other troubled ear, via an external electric wire. Two digital hearing aid cells are connected with each other via signal, power, and ground wires to thereby adjust a time delay parameter and thus make a time delay effect between the two microphones, so that a wearer who wears the digital hearing aid can better hear sound which comes from the side opposing the healthy ear, that is, from the troubled ear side.

1 Claim, 4 Drawing Sheets

DIGITAL HEARING AID ENHANCING DIRECTIONAL PERFORMANCE

TECHNICAL FIELD

The present invention relates to a hearing aid in a medical equipment technological field, and more particularly to a hearing aid in which In-The-Ear ITE type hearing aid cells are inserted into both ears, and one microphone is incorporated into each hearing aid cell so as to adjust the phase between the microphones and make a time delay effect between the two microphones, so that a wearer who wears the digital hearing aid can better hear sound which comes from the side opposing the healthy ear, that is, from the troubled ear side.

BACKGROUND ART

Among the currently available hearing aids, ITE type hearing aids are widely used. For example, an ITE type hearing aid may be used for a sole-ear auditory handicapped person, that is a person having one healthy ear and the other ear having hearing impairments. Even in the case of the sole-ear auditory handicapped person, he or she may wear hearing aids onto both ears, that is, the one healthy ear and the other troubled ear. In the sole-ear auditory handicapped person there is no wearing effect of the hearing aid at the healthy ear side, and as such sound signals amplified at the troubled ear side should be transmitted to the healthy ear side via external circuit cables, so as to be heard via the hearing aid worn at the healthy ear side. In this manner, the wearer can hear sounds coming from both the troubled ear side and the healthy ear side.

In the above-described conventional hearing aids for sole-ear auditory handicapped persons, one microphone is incorporated in an ITE type hearing aid cell that is inserted into a troubled ear, and an ear cell including a receiver is inserted into the healthy ear so that signals amplified at the troubled ear side can be heard at the healthy ear side.

The conventional hearing aids problems arise because a time delay is produced in the process of converting the electric signals amplified at the troubled ear side into a sound pressure at the healthy ear side. That is, the conventional hearing aid for a sole-ear auditory handicapped person is employed without considering a time delay between the healthy ear side and the troubled ear side. Thus, a wearer who wears the conventional hearing aid for a sole-ear auditory handicapped person may lose a directional sense with respect to sounds. Further, a hearing ability of the healthy ear may be weakened since an ear cell is inserted into the healthy ear.

Many auditory handicapped persons have one healthy ear and the other troubled ear. Thus, it is necessary to develop a hearing aid for a sole-ear auditory handicapped person. In particular, it is necessary to develop a hearing aid with which sounds coming from both ear sides can be heard well even though the sole-ear auditory handicapped person wears a hearing aid cell and an ear cell in his or her both ears, respectively.

DISCLOSURE OF THE INVENTION

To solve the above problems, it is an object of the present invention to provide a hearing aid with which sounds coming from both ear sides can be heard well even though a sole-ear auditory handicapped person wears a hearing aid cell and an ear cell in his or her both ears, respectively.

It is another object of the present invention to provide a digital hearing aid enhancing a directional performance for a patient who suffers from sole-ear hearing impairments in which the digital hearing aid cell inserted into one healthy ear is electrically connected with another digital hearing aid cell called an ear cell including a microphone worn in the other troubled ear, via an external electric wire.

To accomplish the above object of the present invention, there is provided a hearing aid comprising: a digital ITE (In-The-Ear) type hearing aid cell including a digital amplifier, a microphone and a receiver in one healthy ear; and an ear cell including a microphone in the other troubled ear, wherein the digital hearing aid cell and the ear cell are connected via external electric wires, to thereby enhance a directional performance of the hearing aid.

Preferably, electronic components incorporated in the healthy-ear hearing aid cell are a front microphone, a switch, a receiver, a digital interface connection terminal and a battery door, while an electronic component incorporated in the troubled-ear ear cell is a rear microphone.

Preferably, a time delay parameter in the digital amplifier is designed to adjust a directional performance in the hearing aid.

BRIEF DESCRIPTION OF THE DRAWINGS

The above and other objects and advantages of the present invention will become more apparent by describing the preferred embodiment thereof in detail with reference to the accompanying drawings.

BEST MODE FOR CARRYING OUT THE INVENTION

Hereinbelow, a hearing aid for a sole-ear auditory handicapped person according to the present invention will be described with reference to the accompanying drawings.

Figure 1:
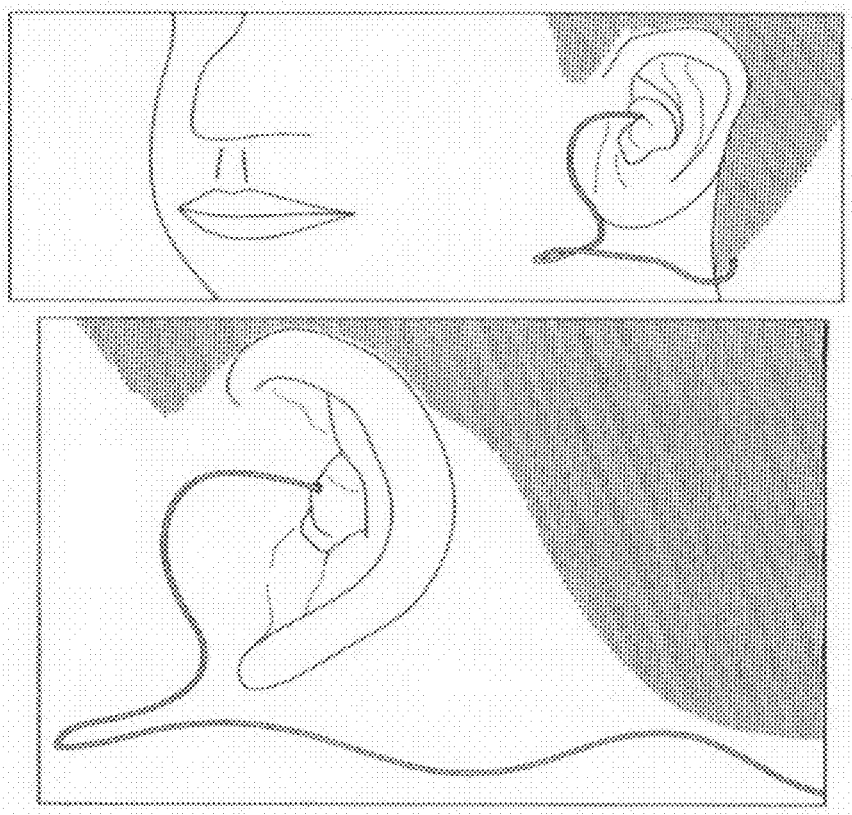
FIG. 1 is an illustration showing a healthy ear at the state where a user has worn an (In-The-Ear) ITE type hearing aid according to the present invention.
Figure 2:
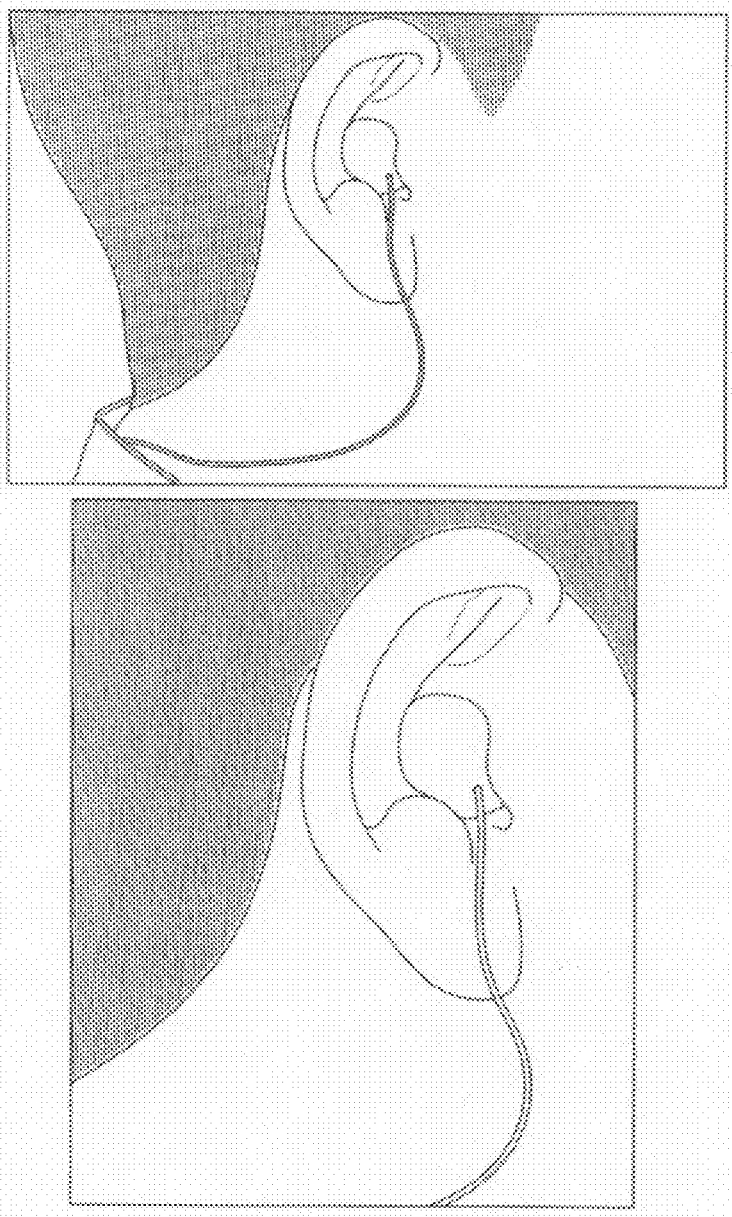
FIG. 2 is an illustration showing a troubled ear at the state where a user has worn an ITE type hearing aid cell called an ear cell according to the present invention.

As shown in FIGS. 1 and 2, an In-The-Ear (ITE) type hearing aid according to the present invention includes an ITE type hearing aid cell inserted at one healthy ear side and an ear cell inserted at the troubled ear side.

Figure 4:
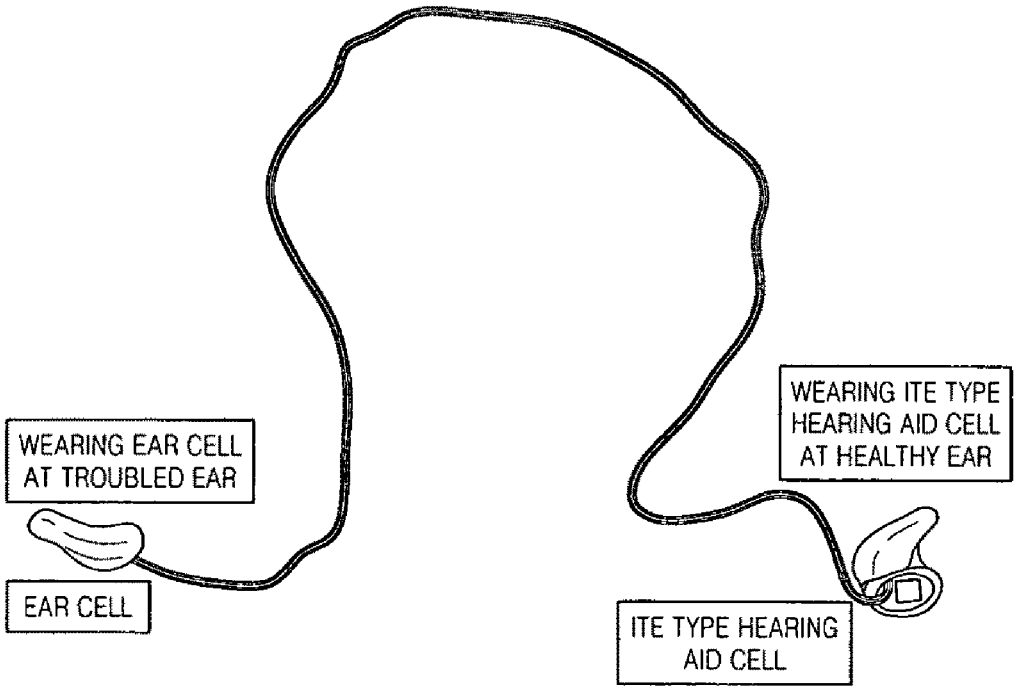
FIG. 4 is an illustration showing the ITE type hearing aid cell and an ear cell which are connected via electric wires according to an embodiment of the present invention.

As shown in FIG. 4, an ITE type hearing aid cell inserted at one healthy ear side and an ear cell inserted at the troubled ear side are connected with each other via three lines, the three lines being signal, power, and ground wires.

Figure 3:
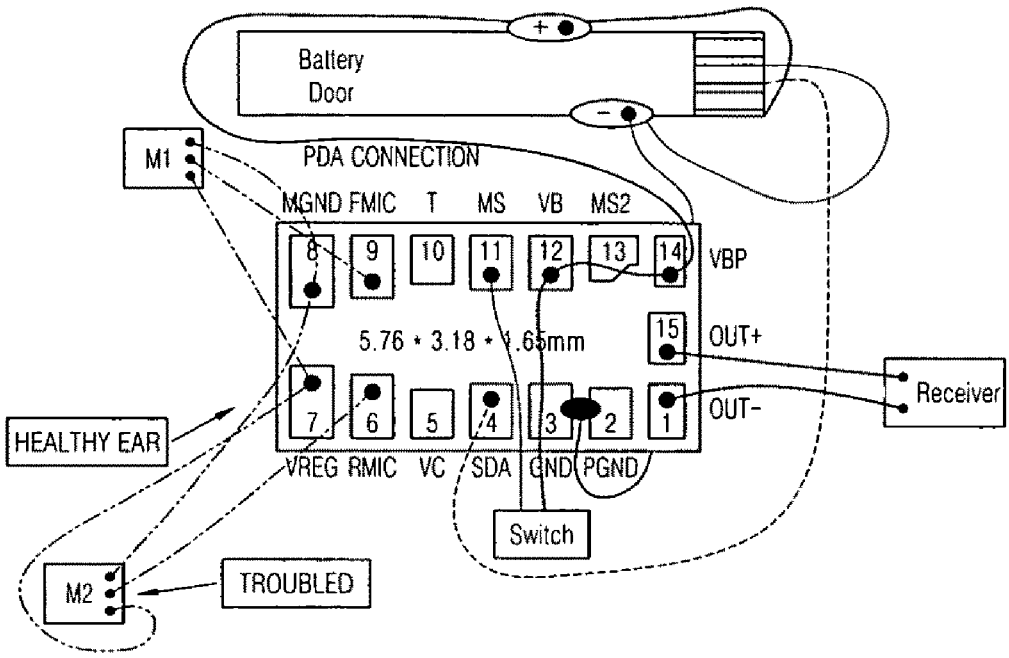
FIG. 3 shows the inner structure of an ITE type digital hearing aid in which digital amplifier chip terminals incorporated in the digital hearing aid are connected with hearing aid electronic components such as microphones, a receiver, a memory diverting switch, a battery door, and an external interface socket.

Referring to FIG. 3, in the case of a digital hearing aid cell at the healthy ear side, digital amplifier chip terminals are connected with and soldered to hearing aid electronic components such as microphones, a receiver, a memory diverting switch, a battery door, and an external interface socket via internal wires.

In FIG. 3, a reference symbol M1 denotes a front microphone that is inserted into a healthy-ear hearing aid cell, and a reference symbol M2 denotes a rear microphone that is inserted into an ear cell at the troubled ear side. That is, a microphone is inserted into both the ITE type hearing aid cell and the ear cell. The digital amplifier chip uses the front and rear microphones M1 and M2 simultaneously, to thereby adjust a time delay. For this purpose, the healthy-ear hearing aid cell and the troubled-ear ear cell are connected via three lines of external wires. Also, a switch in FIG. 3 is a memory diverting switch which is incorporated in a healthy-ear hearing aid cell, and a receiver therein is a general receiver which is incorporated in a healthy-ear hearing aid cell. Also, a terminal SDA in a pad connection diagram of FIG. 3 is a connection terminal for digital interface with an external controller personal computer. Also, a battery door is a hearing aid battery chamber that is incorporated in the healthy-ear hearing aid cell, through which a hearing aid dry cell is inserted and released. These components such as the front and rear microphones M1 and M2, the switch, the receiver, the socket and the battery chamber are connected to pad connection terminals of the IC chip on a Printed Circuit Board (PCB).

The electronic components incorporated in the healthy-ear hearing aid cell are the front microphone M1, the switch, the receiver, the digital interface connection terminal SDA and the battery door, while the electronic component incorporated in the troubled-ear ear cell is the rear microphone M2, A time delay parameter in a digital amplifier is designed and fabricated so as to adjust a directional performance in a hearing aid. Since a distance between two microphones incorporated at the healthy ear side and the troubled ear side, respectively, is the size of the head of a common person, that is, about 18 cm, an effect of an array of the microphones is very excellent to thereby adjust a directional performance as desired.

The present invention provides an effect of enhancing the directional performance of a hearing aid in which a sole-ear auditory handicapped person who has one healthy ear and the other troubled ear wears an ITE type hearing aid cell and at the healthy ear side and an ear cell incorporated with a microphone at the troubled ear side, and the hearing aid cell and the ear cell are connected by external electric wires.

INDUSTRIAL APPLICABILITY

As described above, the present invention provides a hearing aid for a sole-ear auditory handicapped person who has one healthy ear and the other troubled ear wears an ITE type hearing aid cell at the healthy ear side and an ear cell incorporated with a microphone at the troubled ear side, and the hearing aid cell and the ear cell are connected by external electric wires.

As described above, the present invention has been described with respect to particularly preferred embodiments. However, the present invention is not limited to the above embodiments, and it is possible for one who has an ordinary skill in the art to make various modifications and variations, without departing from the spirit and scope of the present invention. Thus, the protective scope of the present invention is not defined within the detailed description thereof but is defined by the claims to be described later and the technical spirit of the present invention.

What is claimed is:

1. A hearing aid comprising:

a digital ITE (In-The-Ear) type hearing aid cell including a digital amplifier, a front microphone, and a receiver in one healthy ear; and an ear cell including a rear microphone in the other troubled ear, wherein the digital hearing aid cell and the ear cell are connected via three external electric wires, the three external wires comprising signal, electric power, and ground wires, to adjust a time delay parameter and thus enhance a directional performance of the hearing aid.

* * * * *